US007081025B2

(12) United States Patent
Zhang et al.

(10) Patent No.: US 7,081,025 B2
(45) Date of Patent: Jul. 25, 2006

(54) ELECTRICAL CONNECTOR WITH IMPROVED CONTACTS

(75) Inventors: Hougbo Zhang, Kunsan (CN); Yi-Sheng Lin, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/950,078

(22) Filed: Sep. 23, 2004

(65) Prior Publication Data

US 2005/0064766 A1 Mar. 24, 2005

(30) Foreign Application Priority Data

Sep. 23, 2003 (CN) ..... 03 2 78766

(51) Int. Cl.
*H01R 13/502* (2006.01)

(52) U.S. Cl. ..... 439/700

(58) Field of Classification Search ..... 439/700, 439/288, 660, 65, 287
See application file for complete search history.

(56) References Cited

U.S. PATENT DOCUMENTS 4,664,458 A * 5/1987 Worth ..... 439/82
5,308,252 A * 5/1994 Mroczkowski et al. ..... 439/66
5,904,597 A * 5/1999 Doi et al. ..... 439/660
6,312,295 B1 * 11/2001 Nishimatsu ..... 439/700
6,315,576 B1 * 11/2001 Neidich ..... 439/66
6,524,140 B1 2/2003 Takagi et al.
6,935,901 B1 * 8/2005 Simpson et al. ..... 439/700

* cited by examiner

*Primary Examiner*—Alexander Gilman
(74) *Attorney, Agent, or Firm*—Wei Te Chung

(57) ABSTRACT

An electrical connector (100) is provided for mating with a mating connector and includes an insulator (21) having a number of recesses (213) therein and a number of conductive contacts (22) received in the recesses. Each recess provides an inclined surface (217A) therefrom. Each conductive contact includes a rear fixing portion (221), a front contacting arm (224) and a spring portion (223) elastically connecting the contacting arm to the fixing portion. The contacting arm includes a contacting portion (226) and an inclined engaging edge (225A) normally riding on the inclined surface. The contacting portion is adapted for receiving a mating force from the mating connector in a first direction to be movable in the first direction. The engaging edge is movable along the inclined surface to render the contacting portion move in a second direction perpendicular to the first direction.

14 Claims, 3 Drawing Sheets

ELECTRICAL CONNECTOR WITH IMPROVED CONTACTS

CROSS-REFERENCE TO RELATED APPLICATION

This application is related to a U.S. patent application entitled "ELECTRICAL CONNECTOR HAVING RELIABLE CONTACTS" with the same applicants and assigned to the common assignee.

BACKGROUND OF THE INVENTION

1. Field of the Invention

The present invention generally relates to the art of electrical connectors and more particularly, to an electrical connector having a contact element for elastically movable connecting with a complementary electrical connector.

2. Description of the Prior Art

Spring contacts for electrical interfaces are well known in the prior art and represent a wide family of technology for providing interconnection between electrical contact elements. A known type of such a conventional connector (U.S. C1. 439/700) is disclosed in U.S. Pat. No. 6,524,140 B2 issued to Takagi et al. on Feb. 25, 2003. The Takagi connector comprises an insulator and a plurality of conductive contacts received in the insulator. Each contact includes a contacting arm having a contact point extending beyond a mating opening of the insulator, and a spring portion integrally formed with the contacting arm. The insulator has a stopper portion adjacent to the mating opening thereof for elastically pressing a lower portion of the spring portion inwardly, thereby maintaining the contacting arm in a normal downwardly inclined state. When the connector mates with a complementary connector, the contacting arm of each contact is depressed inwardly and is free from the pressing of the stopper portion of the insulator, thereby moving upwardly relative to the complementary connector. As a result, the contacting arm upwardly goes back to a horizontal state.

However, being always pressed by the stopper portion of the housing, the spring portions of the contacts of the Takagi connector may be distorted or become robustless after repeatedly mating with the complementary connector, thus the contacts can not electrically and reliably connect with mating contacts of the complementary connector. Moreover, it is desired that the contacting portions be clean and having a low contact resistance. The Takagi contacts move from the inclined position to the horizontal position to provide the so-called "wiping effect". Due to elastic distortion of the Takagi contacts, a distance between inclined position and the horizontal position will be decreased, thus rendering unsatisfied wiping effects.

Hence, an electrical connector with improved contacts is desired to overcome the foregoing shortcomings.

BRIEF SUMMARY OF THE INVENTION

An object of the present invention is to provide an electrical connector having improved contacts capable of providing large wiping effects upon plugging.

An electrical connector is provided for mating with a mating connector and includes an insulator having a number of recesses therein and a plurality of conductive contacts received in the recesses. Each recess provides a raised section projecting inwardly therefrom. The raised section has an inclined surface thereon. Each conductive contact includes a rear fixing portion, a front contacting arm and a spring portion elastically connecting the contacting arm to the fixing portion. The contacting arm includes a contacting portion and an engaging portion. The contacting portion is adapted for receiving a mating force from the mating connector in a first direction to be movable in the first direction. The engaging portion has an inclined engaging edge normally riding on the inclined surface. The engaging edge is movable along the inclined surface to render the contacting portion move in a second direction perpendicular to the first direction.

Other objects, advantages and novel features of the invention will become more apparent from the following detailed description when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures.

DETAILED DESCRIPTION OF THE INVENTION

Figure 1:
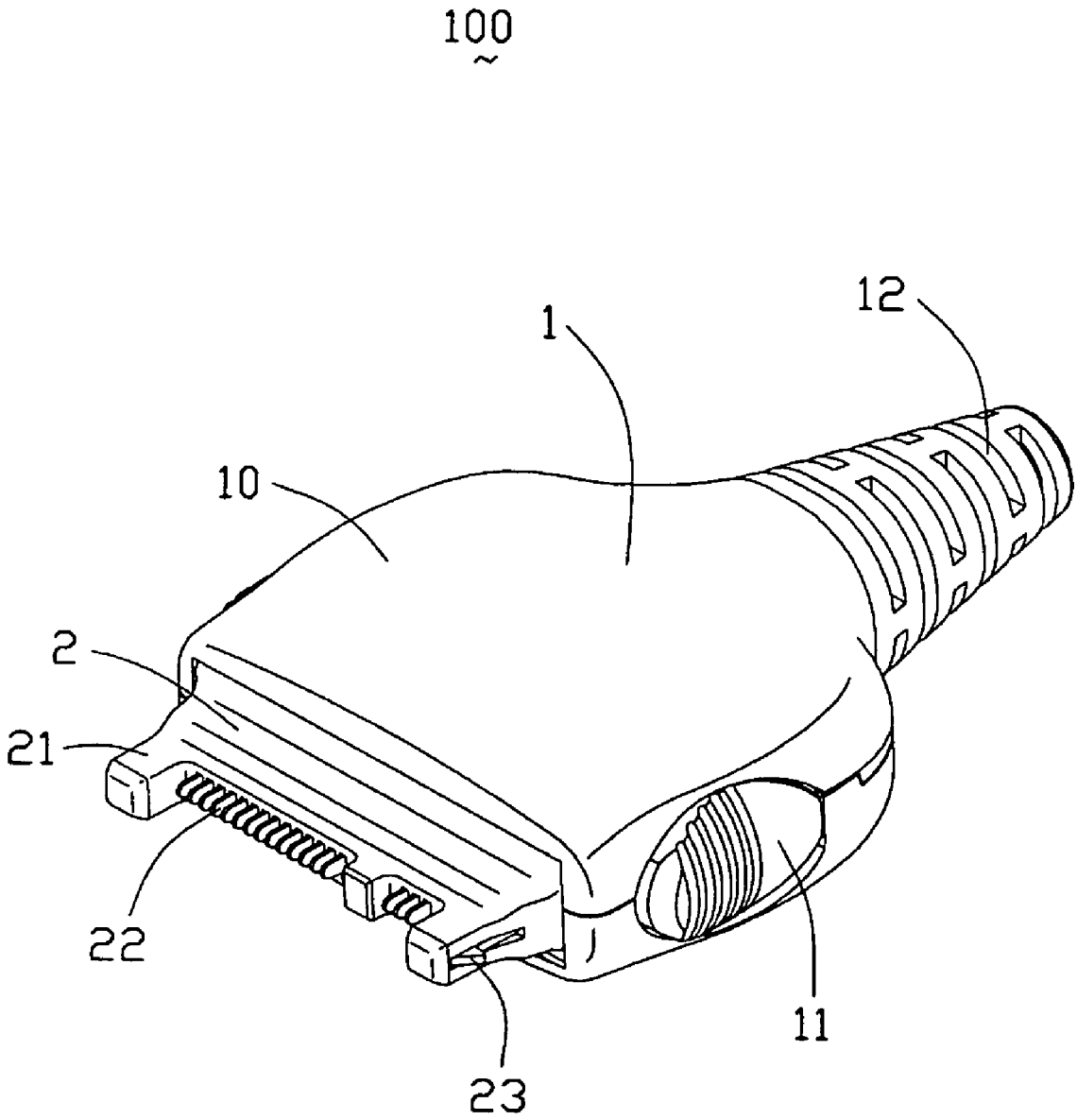
FIG. 1 is a perspective view of an electrical connector according to the present invention.

Referring to the drawings in greater detail, and first to FIG. 1, the invention is embodied in an electrical connector, generally designated 100, which is adapted for mating with a mating connector. The electrical connector 100 comprises a dielectric casing 1 and a connector module 2 received in the dielectric casing 1. The dielectric casing 1 includes a base portion 10, a pair of buttons 11 positioned in opposite sides of the base portion 10, and a cable holder portion 12 extending rearwardly from the base portion 10 for holding a cable therein. However, it should be understood that various features of the invention are equally applicable for other types of connectors, as will be fully understandable from the following detailed description.

Figure 2:
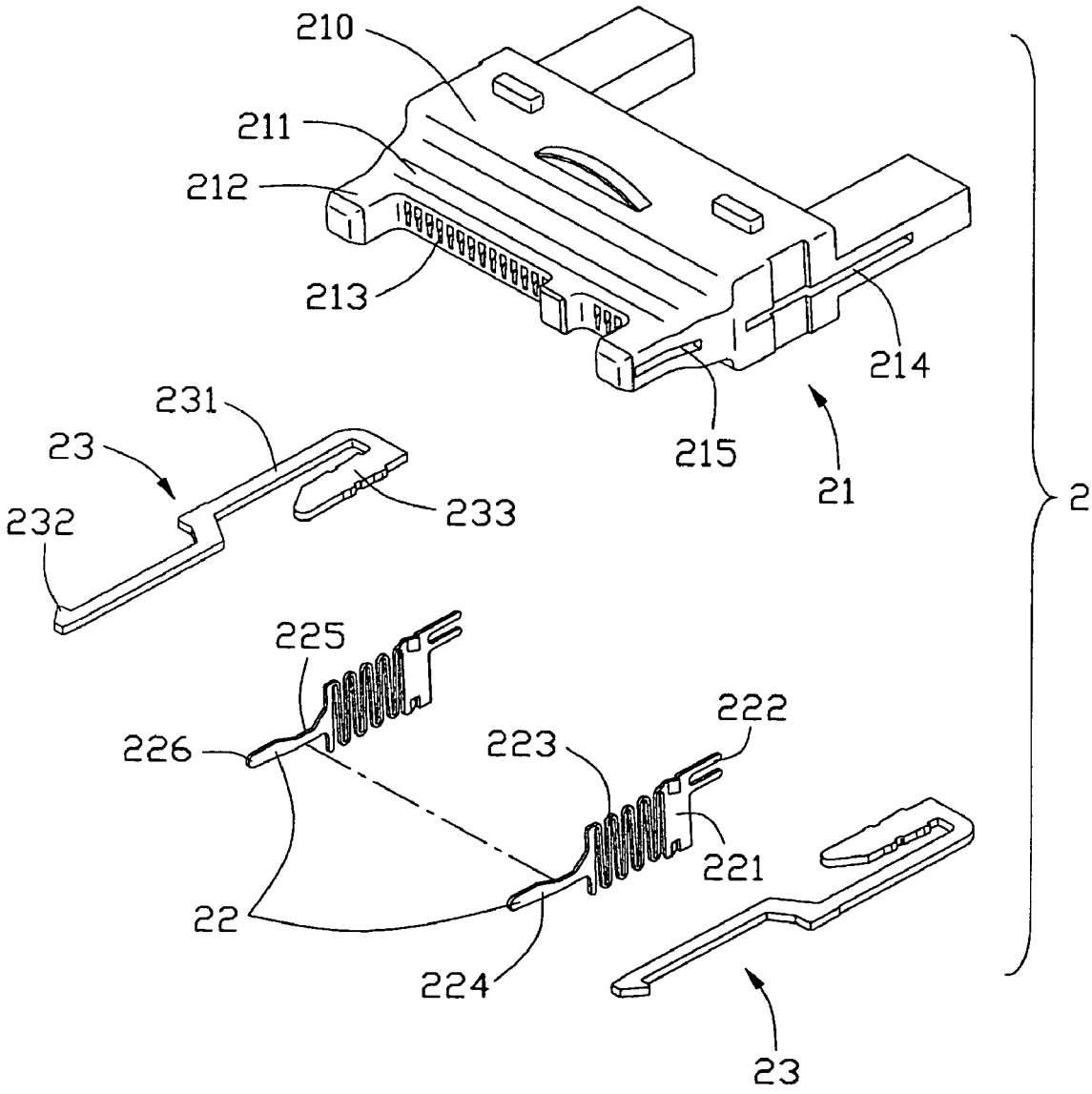
FIG. 2 is an exploded view of a connector module of the electrical connector.
Figure 3:
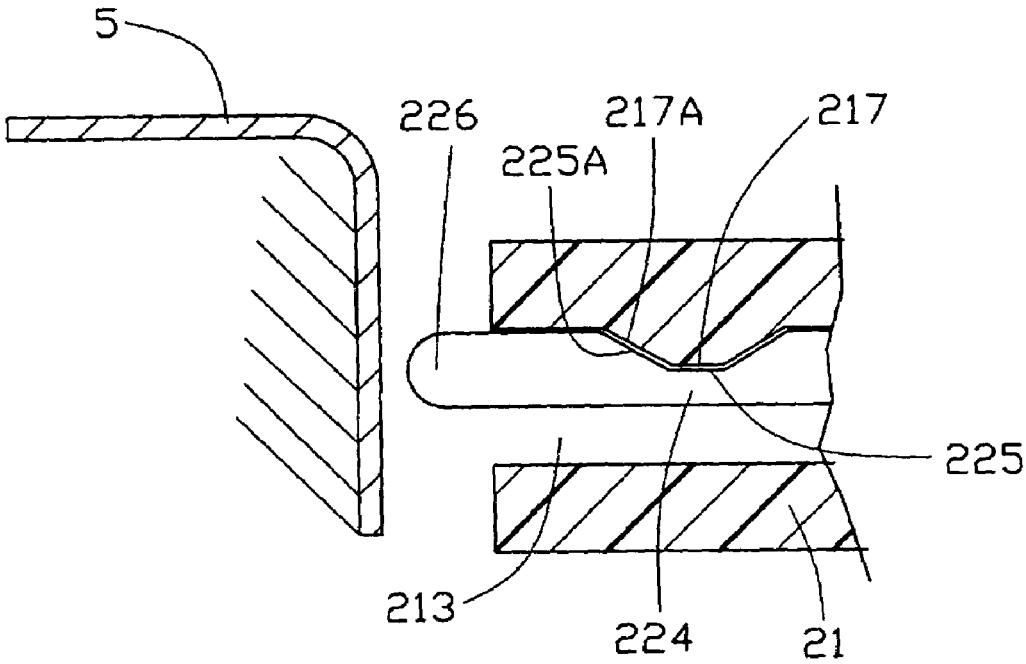
FIG. 3 is a partially sectional enlarged view of the connector module illustrated in FIG. 2 before connection with a mating connector.

Referring to FIGS. 2 and 3 and in conjunction with FIG. 1, the connector module 2 comprises an insulator 21 partially projecting out of the dielectric casing 1, a plurality of conductive contacts 22 fixed in the insulator 21 and a pair of latching arms 23 received in the insulator 21.

The insulator 21 is a one-piece structure unitarily molded of dielectric material such as plastic or the like. The insulator 21 includes a generally U-shaped base portion 210, a mating portion 211 having a front mating end (not labeled) and a pair of guiding portions 212 extending forwardly from opposite sides of the mating portion 211. A plurality of recesses 213 are spaced apart in the insulator 21 for receiving the conductive contacts 22. A pair of first grooves 214 are defined in opposite sides of the base portion 210 of the insulator 21 corresponding to the buttons 11. A pair of second grooves 215 are defined in opposite sides of the guiding portion 212 and communicate with corresponding first grooves 214. Each recess 213 has a raised section 217 (shown in FIG. 3) projecting downwardly from an upper inner wall thereof. The raised section 217 has a front inclined surface 217A extending downwardly and rearwardly from the upper inner wall of the recess 213 at an obtuse angle, and preferably between 120° and 150° to the upper inner wall. The raised section 217 is positioned adjacent to the front mating end of the electrical connector 100 for normally engaging with the conductive contacts 22, as will be discussed hereinafter.

Referring to FIGS. 2 and 3, each conductive contact 22 comprises a rectangular rear fixing portion 221 for vertically being fixed in a corresponding recess 213, a substantially U-shaped soldering portion 222 extending rearwardly from the fixing portion 221, an elongate front contacting arm 224 for mating with the mating connector and a spring portion 223 elastically connecting the contacting arm 224 to the fixing portion 221. The spring portion 223 is formed along a longitudinal axis (not labeled) of the contact 22 and has a serpentine shape between the fixing portion 221 and the contacting arm 224. The contacting arm 224 extends forwardly from the spring portion 223 and includes an engaging portion 225 and a contacting portion 226 in a front end thereof. The engaging portion 225 is a substantially trapeziform-shaped recess defined in a top edge of the contacting arm 224 for engaging with the raised section 217 of the insulator 21. The engaging portion 225 has an inclined engaging edge 225A extending downwardly and rearwardly, and facing away from the contacting portion 226 for engaging with the inclined surface 217A of the raised section 217 of the insulator 21.

As best shown in FIG. 2, each latching arm 23 includes a fixing portion 233 securely retained in the insulator 21, a resilient driving portion 231 and a latching portion 232 integrally and forwardly extending from the driving portion 231.

Referring to FIGS. 1, 2 and 3, in assembly, the conductive contacts 22 are received in respective ones of the recesses 213 with the contacting portions 226 forwardly projecting beyond the mating portion 211 of the connector body 21. The engaging portion 225 of the contacting arm 224 of each contact 22 engages with the raised section 217 with the engaging edge 225A immediately above the raised surface 217A of the raised section 217. The driving portions 231 and the fixing portions 233 of the latching arms 23 are positioned in the first grooves 214 of the insulator 21 for engaging with a corresponding button 11. A front portion of the driving portion 231 of each latching arm 23 extends into the second groove 215 of the insulator 21. The latching portion 232 extends forwardly beyond the second groove 215 of the insulator 21 for engagement with appropriate latch means of the mating connector. The connector module 2 is assembled to the dielectric casing 1 after the conductive contacts 22 and the latching arms 23 are installed therein.

Figure 4:
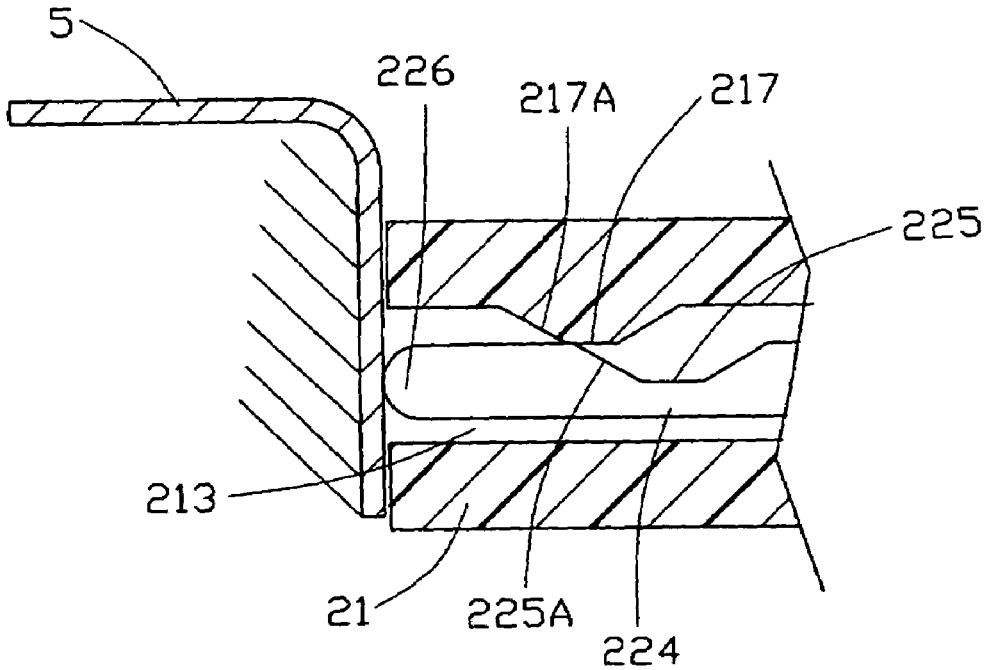
FIG. 4 is a partially sectional enlarged view of the connector module illustrate in FIG. 2 at the completion of connection with the mating connector.

Referring to FIGS. 3 and 4 in conjunction with FIGS. 1 and 2, when the electrical connector 100 mates with the mating connector, the buttons 11 are inwardly pressed and urges the driving portions 231 of the latching arms 23 to move inwardly, thereby rendering the latching portions 232 received in the second grooves 215 of the insulator 21 and allowing the mating occurs. The contacting portion 226 of each contact 22 is rearwardly pressed by mating contacts 5 of the mating connector, and the spring portion 223 is flexed to permit the contacting portion 226 to move rearwardly or in a first direction. When the contacting portion 226 is moved rearwardly, the inclined engaging edge 225A of the engaging portion 225 of each contacting arm 224 slides downwardly and rearwardly along the inclined surface 217A. Therefore, the contacting portion 226 is received downwardly force from the raised section 217 in a second direction perpendicular to the first direction, thereby downwardly moving relative to the mating contact 5 of the mating connector. The engagement of the engaging portion 225 and the raised section 217 increases the range of sliding movement of the contacting portion 226. When the mating completed, the driving portions 231 are released and urge the buttons 11 move outwardly, thereby the latching portion 232 of the electrical connector 100 respectively engaging with counterpart locking portions of the mating connector to secure the electrical connector 100 to the complementary connector.

To disengage the electrical connector 100 from the mating connector, the buttons 11 are inwardly depressed, the driving portions 231 of the latching arms 23 are inwardly moved, thereby disengaging the latching portion 232 from the mating connector and releasing the electrical connector 1 from the complementary connector. The spring portions 223 of the contacts 22 are released and urge the contacting arm 224 to the normal position.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a plurality of passageways therein, each of said passageway defining lengthwise and lateral directions perpendicular to each other, and essentially formed by a circumferential wall structure, and a protrusion being defined on said circumferential wall structure;

a plurality of conductive contacts disposed in the corresponding passageways respectively, each of said contacts defining thereof a contact section at a tip end, and a resilient deflectable medial section for allowing said contact section to move backwardly in both said lengthwise direction and said lateral direction of the corresponding passageways; wherein said contact farther defines a recess snugly compliantly engageably receiving the protrusion therein when said contact in a relaxed manner with the contact section extending out of the housing in a relatively stable manner along both lateral and lengthwise directions, while said protrusion leaves the recess and deflects the contact in the lateral direction when the contact is deflected by deflected by a mating connector in said lengthwise direction.

2. The electrical connector according to claim 1, wherein said recess is located on a relatively stiff section of the contact in comparison with die medial section.

3. The electrical connector according to claim 1, wherein said medial section is essentially of a serpentine type providing compressibility along the lengthwise direction and deflection along the lateral direction thereof, and thus the contact section is moveable in essentially a translation manner when the contact is pressed by the mating connector.

4. The electrical connector according to claim 1, further comprising a latching arm securely retained in the insulator, and wherein the insulator forms a button capable of actuating the latching arm to latch with a complementary connector.

5. The electrical connector according to claim 4, wherein the latching ann comprising a fixing portion retained with the insulator, a resilient driving portion capable of being actuated by the button, and a latching portion forwardly extending from the driving portion and capable of latching with the complementary connector.

6. The electrical connector according to claim 1, wherein said recess is located in a front contact arm located between the contact tip and the medial section.

7. The electrical connector according to claim 6, wherein the medial section is mainly deformed in the lengthwise while the contact arm experiences less deformation but a displacement in both lengthwise and lateral direction.

8. The electrical connector according to claim 1, wherein said contact is of a blanking type experiencing only stamping without bending, thus fully located on a plane.

9. The electrical connector according to claim 8, wherein a thickness of said contact is constant in a direction perpendicular to said plane.

10. The electrical connector according to claim 9, wherein a width of the contact on the medial section is smaller than that on other portions thereof.

11. The electrical connector according to claim 6, wherein said contact is of a blanking type experiencing only stamping without bending, thus fully located on a plane with a constant thickness in a direction perpendicular to said plane, and a width of the front contact arm is varied due to said recess.

12. An electrical connector comprising:

an insulative housing defining a plurality of passageways therein, each of said passageway defining lengthwise and lateral directions perpendicular to each other, and essentially formed by a circumferential wall structure, and a first configuration being defined on said circumferential wall structure:

a plurality of conductive contacts disposed in the corresponding passageways respectively, each of said contacts of a blanking type with a constant thickness and variable widths thereof, and defining a contact section at a tip end, and a resilient deflectable medial section for allowing said contact section to move backwardly in both said lengthwise direction and said lateral direction of the corresponding passageway; wherein said contact further defines as second configuration snugly compliantly engaged with the first configuration therein when said contact is in a relaxed manner with the contact section extending out of the housing in a relatively stable manner along both lateral and lengthwise directions, while said first configuration and said second configuration are disengaged from each other and the contact is deflected in the lateral direction because of at least one of the said first and second configurations when the contact is deflected by a mating connector in said lengthwise direction.

13. The electrical connector according to claim 12, wherein said medial section is essentially of a serpentine type providing compressibility along the lengthwise direction and deflection along the lateral direction thereof, and thus the contact section is moveable in essentially a translation manner rater than a deflection manner when the contact is pressed by the mating connector.

14. The electrical connector according to claim 12, wherein said thickness is smaller than the width.

* * * * *